US006238142B1

(12) United States Patent
Harsch

(10) Patent No.: US 6,238,142 B1
(45) Date of Patent: May 29, 2001

(54) APPARATUS FOR ERECTING A FOUNDATION ELEMENT IN THE GROUND

(75) Inventor: Christoph Alois Harsch, Schrobenhausen (DE)

(73) Assignee: Bauer Spezialtiebau GmbH, Schrobenhausen (DE)

( * ) Notice: Subject to any disclaimer, the term of this patent is extended or adjusted under 35 U.S.C. 154(b) by 0 days.

(21) Appl. No.: 09/262,004

(22) Filed: Mar. 4, 1999

(30) Foreign Application Priority Data

Mar. 6, 1998 (DE) ..... 298 04 010

(51) Int. Cl.[7] ..... E02D 15/02; G01L 7/08

(52) U.S. Cl. ..... 405/241; 405/236; 175/48; 73/715; 73/730

(58) Field of Search ..... 405/240, 241, 405/233, 269, 236; 73/715, 730; 175/48

(56) References Cited

U.S. PATENT DOCUMENTS

| | | | | |
|---|---|---|---|---|
| 3,300,988 | * | 1/1967 | Phares et al. | 405/241 X |
| 3,344,611 | * | 10/1967 | Philo | 405/240 |
| 3,391,544 | * | 7/1968 | Daczko | 405/241 |
| 3,507,124 | * | 4/1970 | Turzillo | 405/241 |
| 3,595,075 | * | 7/1971 | Mayhew, Jr. | 175/48 X |
| 3,657,894 | * | 4/1972 | Parez | 405/241 |
| 3,690,109 | | 9/1972 | Turzillo . | |
| 3,807,184 | | 4/1974 | Turzillo . | |
| 3,969,902 | * | 7/1976 | Ichise et al. | 405/266 X |
| 4,100,750 | * | 7/1978 | Labrue | 405/241 |
| 4,229,122 | * | 10/1980 | Ballantyne | 405/240 X |
| 4,297,880 | * | 11/1981 | Berger | 73/152.22 |
| 4,309,129 | * | 1/1982 | Takahashi | 405/269 |
| 4,570,553 | * | 2/1986 | Ito | 405/269 X |
| 4,840,068 | * | 6/1989 | Mayhew, Jr. | 73/730 |
| 4,958,962 | * | 9/1990 | Schellhorn | 405/269 X |
| 5,163,784 | * | 11/1992 | Kunito | 405/269 X |
| 5,542,786 | * | 8/1996 | Blum | 405/240 |

* cited by examiner

*Primary Examiner*—Eileen D. Lillis
*Assistant Examiner*—Tara L. Mayo
(74) *Attorney, Agent, or Firm*—Nixon Peabody LLP; Donald R. Studebaker

(57) ABSTRACT

An apparatus for erecting a foundation element in a ground surface including a drilling device, a pumping device, a pressure transducer and a control unit. The drilling device includes a hollow core tube and an auger bit adapted to drill a hole in the ground surface while the pumping device is adapted to pump a solidifying suspension material under pressure through the hollow core tube and into the hole in the ground surface. In addition, the pressure transducer is mounted on the core tube and is adapted to provide a pressure signal indicative of a pressure of the solidifying suspension material in the core tube while the control unit is adapted to control the pressure of the solidifying suspension material.

19 Claims, 4 Drawing Sheets

APPARATUS FOR ERECTING A FOUNDATION ELEMENT IN THE GROUND

BACKGROUND OF THE INVENTION

1. Field of the Invention

The present invention relates to an apparatus with a drilling device for erecting or installing a foundation element in the ground. More specifically, the present invention relates to such an apparatus where the drilling device includes a hollow core tube, an auger bit and a pumping device through which a solidifying or settable suspension material, such as concrete, can be passed through the hollow core tube under pressure into a drilled hole or bore.

2. Description of Related Art

Apparatuses for erecting a foundation element such as a pile or a structural column in the ground is currently known and used in the industry. Such apparatus often include a drilling device with a hollow core tube and an auger bit. The drilling device drills a hole into the ground and as the auger bit is withdrawn from the hole, a solidifying suspension material such as concrete/cement is provided into the hole through the hollow core tube. In this regard, the apparatus may also include a pumping device to provided the solidifying suspension material under pressure in order to expedite the filling process and to ensure the hole is filled. For example, bored piles are erected with such apparatuses so that initially, a hole is made by the drilling device and the soil removed is transported away. Concrete is then introduced into the hole via the hollow core tube as the drilling device is removed. Such process and apparatus is disclosed in U.S. Pat. No. 3,690,109 and No. 3,807,184, both to Turzillo. These references disclose the formation of a pile or a structural column produced in an earth situs by drilling with a continuous flight auger to define a cavity of requisite depth, and then withdrawing the auger by incremental extents while feeding a column-forming material through the hollow shaft of the auger.

The problem with the prior art and current systems arises in that the solidifying suspension material such as concrete can pass through various openings and cavities in the hole and proceed into the surrounding soil which was not intended to receive the solidifying suspension material. This creates undesirable waste in using the relatively expensive solidifying suspension material while at the same time, prolongs the time required to complete the filling process thereby diminishing process efficiency.

Therefore, there exists an unfulfilled need for an apparatus for erecting a foundation element in the ground which will minimize the waste of solidifying suspension material. There also exists an unfulfilled need for such an apparatus that will minimize the time required to complete the filling process to maximize process efficiency.

SUMMARY OF THE INVENTION

The first object of the present invention is to provide an improved apparatus for erecting a foundation element in the ground that will minimize the waste of solidifying suspension material.

The second object of the present invention is to provide an improved apparatus for erecting a foundation element in the ground that will minimize the time required to complete the filling process to maximize process efficiency.

Another object of the present invention is to provide an improved apparatus for erecting a foundation element in the ground by providing a pressure transducer that measures the pressure of the solidifying suspension material. The fourth object of the present invention is to provide such an apparatus where the waste of solidifying suspension material is minimized by optimally controlling the pumping pressure of the hole based on the pressure of the solidifying suspension material.

According to one embodiment of the present invention, these objects are achieved by an improved apparatus for erecting a foundation element in a ground surface comprising a drilling device, a pumping device, a pressure transducer and a control unit. The drilling device includes a hollow core tube and an auger bit adapted to drill a hole in the ground surface while the pumping device is adapted to pump a solidifying suspension material such as concrete under pressure through the hollow core tube and into the hole in the ground surface. In addition, the pressure transducer is mounted on the core tube and is adapted to provide a pressure signal indicative of a pressure of the solidifying suspension material in the core tube while the control unit is adapted to control the pressure of the solidifying suspension material. In this embodiment, the pressure transducer may be positioned proximate to the auger bit and the control unit may be adapted to control the pumping device based on the pressure signal from the pressure transducer.

In addition, the drilling device in accordance with the present invention may also comprise a screw auger with a feed helix helically attached to an outer surface of the hollow core tube. The pressure transducer may be electrically connected to the control unit through a lead within the core tube and be connected to a slip ring positioned at an end of the drilling device remote from the auger bit. Sliding contacts and/or brushes adapted to electrically engage the slip ring may also be provided thereby allowing transmission of pressure data and/or electrical power from/to the pressure transducer. Thus, in this reliable manner, data and/or power can be transmitted to the pressure transducer within the rotating drilling device.

In the preferred embodiment of the present invention, the core tube is constructed as a double-walled core tube. The inner tube can be used for supplying the solidifying suspension material and the space between the inner and outer tubes is sealed by a circular stop plate so that the solidifying suspension material from the inner tube cannot penetrate the gap between the two tubes. In this regard, the space between the two tubes can be used for routing the lead from the pressure transducer.

Also in accordance with the present embodiment, the pressure transducer is located on a lower area of the core tube in an increased diameter chamber and face is positioned to the auger bit. In the embodiment using a double-walled core tube, the larger diameter chamber in the lower area is formed by the outer core tube, while the inner tube is shortened and does not project into the area of the chamber. The two ends of the chamber are formed by the aforementioned circular stop plate and the auger bit which may incorporate a cutting device. The solidifying suspension material such as concrete can flow out into the hole through openings in the wall of the outer core tube.

In addition, in accordance with an alternative embodiment of the present invention, the pressure transducer may include a tubular element and an elastic element arranged in a manner to form a measuring chamber thereinbetween, and a sensor adapted to measure pressure in the measuring chamber. In this embodiment, the pressure transducer may also include a suspension passage adapted to allow flow of the solidifying suspension material and two flanges adapted to allow mounting of the pressure transducer to the hollow core tube. In still another embodiment, a reception hole adapted to receive the pressure transducer is provided on the hollow core tube and the pressure transducer includes an elastically deformable measuring chamber wall and a facing sensor wall arranged in a manner to form a measuring chamber such that the sensor measures the pressure in the measuring chamber. A locking ring may also be provided to fixedly hold together a peripheral edge portion of the sensor wall and a peripheral edge portion of the measuring chamber wall.

In yet another alternative embodiment, a transponder device may be provided for wireless data transmission from the pressure transducer to the control unit. The transponder device may also be adapted to provide wireless power transmission from a power supply to pressure transducer. In such embodiment, the transponder device will eliminate the need for the lead, the slip ring as well as the sliding contacts or brushes. Such transponder device would utilize a signal with a specific frequency to activate the pressure transducer to obtain the pressure measurement and to emit this pressure measurement so that it can be received by the control unit. The transponder device can be provided directly on the pressure transducer or can be connected by a lead in place of the slip ring at the upper end of the drilling device.

The present invention is based on the finding there is an undesirably high waste of solidifying suspension material into the neighboring soil upon exceeding specific pressure values. Thus, according to the invention, it is now possible to measure the pressure of the solidifying suspension material in a lower area of the drilling device. This is attained by providing a pressure transducer through which it is possible to establish the actual pressure of the solidifying suspension material in the filling hole. The pressure values determined are communicated outside the hole to a control unit, which controls the capacity of the pump as a function of the values determined. Thus, in accordance with a predetermined program, a desired increase or decrease in the delivery pressure can be obtained. Thus, it is possible to ensure a speedy filling of the hole, while at the same time, minimizing the waste of the solidifying suspension material.

The apparatus according to the invention is suitable for variety of drilling devices in which a filling of the hole takes place on extraction of the drilling device. The apparatus of the present invention is particularly useful in devices for erecting a foundation element in the ground such as in the erection of bored piles. According to the invention, a particularly compact and robust embodiments are obtained in drilling devices such as a continuous screw auger, where a feed helix is arranged around the core tube to transport the soil removed by the auger bit.

These and other objects, features and advantages of the present invention will become more apparent form the following detailed description of the preferred embodiments when viewed in conjunction with the attached drawings.

DETAILED DESCRIPTION OF PREFERRED EMBODIMENTS

Figure 1:
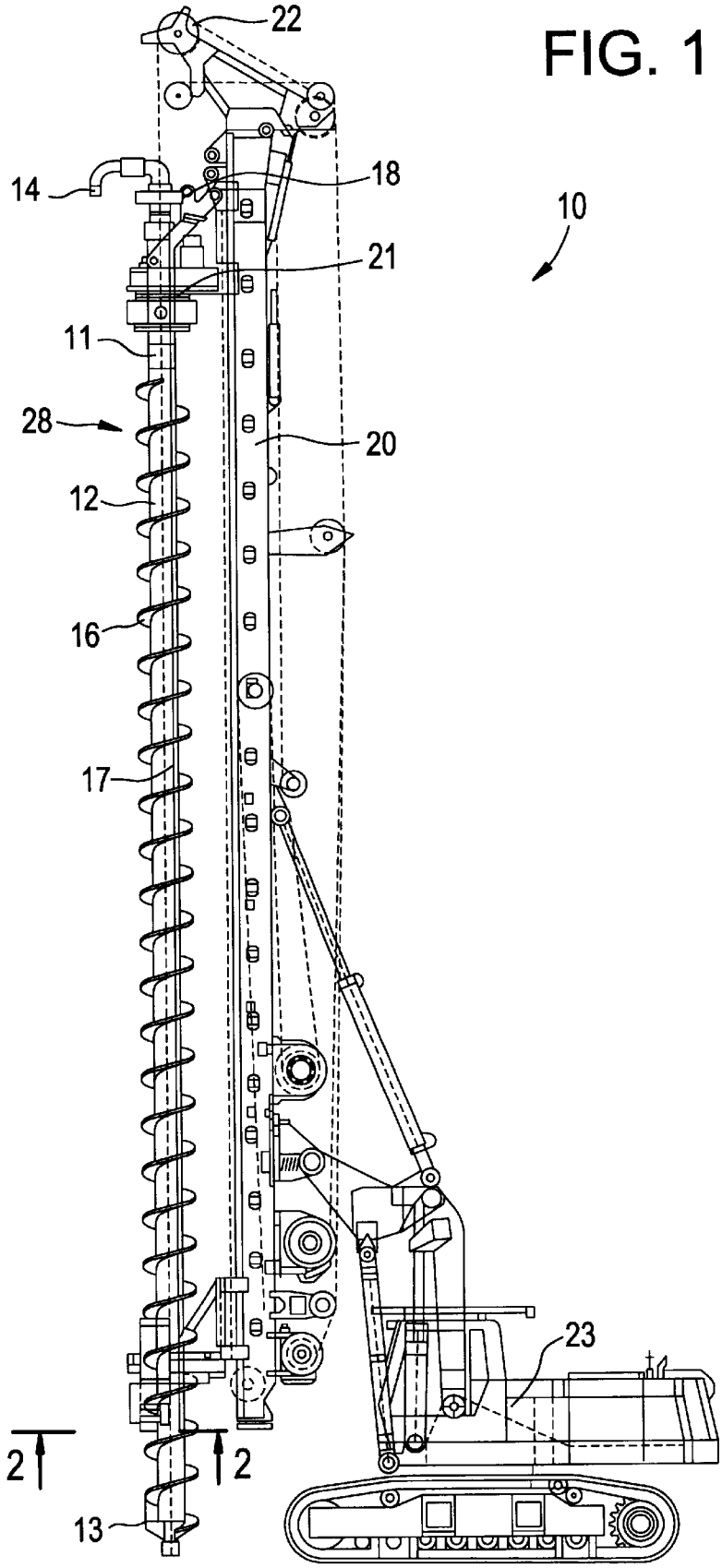
FIG. 1 shows a side view of an apparatus according to the present invention.

FIG. 1 illustrates an apparatus 10 in accordance with one embodiment of the present invention for erecting a foundation element in the ground. As will be discussed hereinbelow, the apparatus according to the present invention is suitable for variety of drilling devices in which a filling of the hole takes place on extraction of the drilling device. The apparatus of the present invention is particularly useful in devices for erecting a foundation element in the ground such as in the erection of bored piles. Therefore, the present invention is illustrated and discussed as applied to a compact and robust drilling devices such as a continuous screw auger where a feed helix is arranged around the core tube to transport the soil removed by the auger bit.

The present invention is based on the finding that there is an undesirable amount of waste of solidifying suspension material into the neighboring soil if the pressure of the solidifying suspension material exceeds a particular level and that such waste also reduces the process efficiency. As previously discussed, the problem with the prior art and current systems arises in that the solidifying suspension material such as concrete can pass through various openings and cavities in the hole and proceed into the surrounding soil which was not intended to receive the solidifying suspension material. This creates undesirable waste in using the relatively expensive solidifying suspension material while at the same time, prolongs the time required to complete the filling process thereby diminishing process efficiency. Therefore, the present invention provides a novel apparatus for erecting a foundation element in the ground which will minimize this waste and minimize the time required to complete the filling process.

In accordance with the embodiment illustrated in FIG. 1, an apparatus 10 comprises a drilling device 11 which is constructed as a continuous screw auger 28 and includes a core tube 12 which is coaxial to a drilling axis. The drilling device 11 is provided with a feed helix 16 which is helically fitted on the outside of the screw auger 28. In the present embodiment, the feed helix 16 begins at an auger bit 13 and extends directly up to a rotary drive 21 at the upper end of the drilling device 11. The auger bit 13 may also incorporate a pilot (not enumerated) and a cutting device (not enumerated) for removing the soil.

The drilling device 11 is mounted on a support 20 in a manner to allow both rotational movement as well as axial displacement of the drilling device 11. The support 20 in turn, is pivotably mounted to a transportation vehicle 23. In operation, the drilling device 11 can be rotated by the rotary drive 21 while being lowered into the ground by means of a cable arrangement 22 along the girder-like support 20 thereby making a drilled hole in the ground surface.

Upon reaching a desired drilling depth, a pumping device (not shown) pumps a solidifying or settable suspension material, such as concrete, under pressure into the hollow core tube 12 through a suspension line 14 at the upper end of the drilling device 11. The solidifying suspension material then flows through the core tube 12, into the area of the auger bit 13, and proceeds to flow into the formed hole as the drilling device 11 is extracted therefrom.

Figure 2:
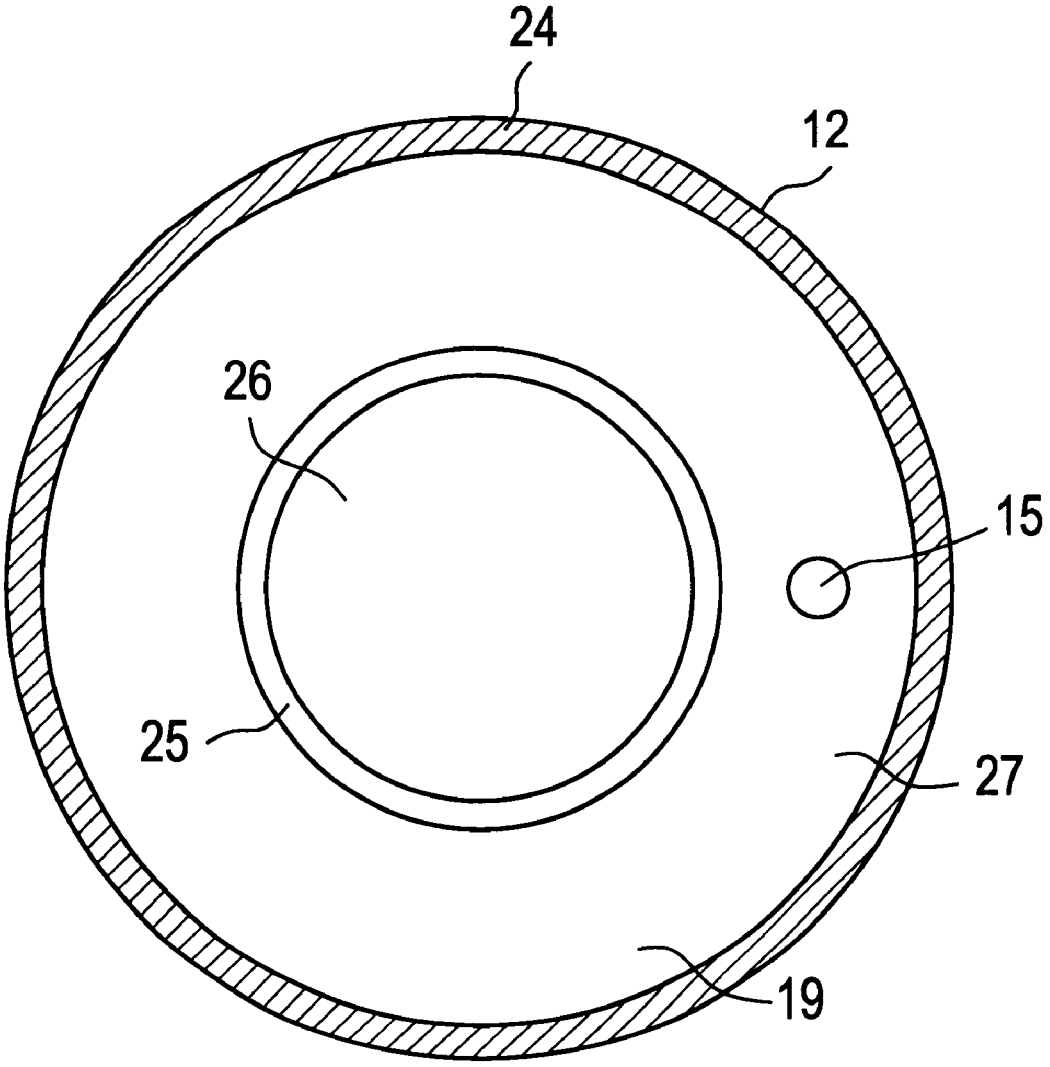
FIG. 2 shows an enlarged cross-sectional view of a drilling device of FIG. 1 viewed from section 2—2 including a pressure transducer.

The area of the drilling device 11 above the auger bit 13 is illustrated in greater detail in FIG. 2 which shows a cross-sectional view the drilling device 11 as viewed along section 2—2 in FIG. 1. As can be clearly seen, in the present embodiment, the core tube 12 is constructed as a double-walled core tube with an outer tube 24 and an inner tube 25 provided coaxial thereto. In this regard, two coaxially arranged tubes of different diameters can be used. The inner tube 25 forms a suspension channel 26 through which the solidifying suspension material, such as concrete, can flow from the pumping device into the hole formed in the ground surface. The inner tube 25 is axially shorter than the outer tube 24 and the radial space between the two tubes is tightly sealed by a circular stop plate 27 at the lower end of the inner tube 25 so that the solidifying suspension material cannot penetrate the gap between the two tubes. Thus, in the area of the drilling device 11 above the auger bit 13, the outer tube 24 forms a larger diameter chamber 19 by which the inflowing solidifying suspension material can flow through channels or openings (not shown) in the vicinity of the hole in the ground.

A pressure transducer 15 for measuring the pressure of the solidifying suspension material within the chamber 19 is provided in the drilling device 11 and may be fixed in a hole (not shown) in the circular stop plate 27. In the present embodiment, the pressure of the solidifying suspension material may be measured by a sensor (not shown) within the pressure transducer 15 and these pressure values can be electrically communicated from the chamber 19 to a control unit (not shown). More specifically, the measured pressure values can be electrically communicated from the pressure transducer 15 to a slip ring 18 positioned outside the drilled hole via a lead 17 provided in the drilling device 11. This lead 17 may be provided in the space between the inner tube 25 and the outer tube 24 of the drilling device 11. The slip ring 18 may be axially aligned and positioned at an upper end of the drilling device 11. Sliding contacts or brushes (not shown) which are in electrical communication with the support 20 can then be provided to ensure electrical contact with the slip ring 18. In this manner, the pressure data from the pressure transducer 15 can be transmitted to the control unit (not shown) of the pumping device (not shown) and the pressure data may be then be used to control and/or regulate the pressure of the solidifying suspension material. This may be attained by regulating a pressure valve (not shown), by controlling the output of the pump, or by other appropriate means. The electric power to the pressure transducer 15 can also be provided in a similar manner using the disclosed slip ring 18.

It should also be recognized that the above described invention may also be easily modified to include a transponder device (not shown) adapted to provide wireless data transmission from the pressure transducer 15 to the control unit (not shown). The transponder device may also be adapted to provide wireless power transmission from a power supply (not shown) to pressure transducer 15. In this regard, such application of a transponder will eliminate the need for the lead 17, the slip ring 18 as well as the sliding contacts/brushes described above. Such transponder device would utilize a signal with a specific frequency to activate the pressure transducer 15 to obtain the pressure measurement and to emit this pressure measurement so that it can be received by the control unit. Of course, the transponder device can be provided directly on the pressure transducer 15 or can be connected by a lead in place of the slip ring at the upper end of the drilling device 11.

Figure 3:
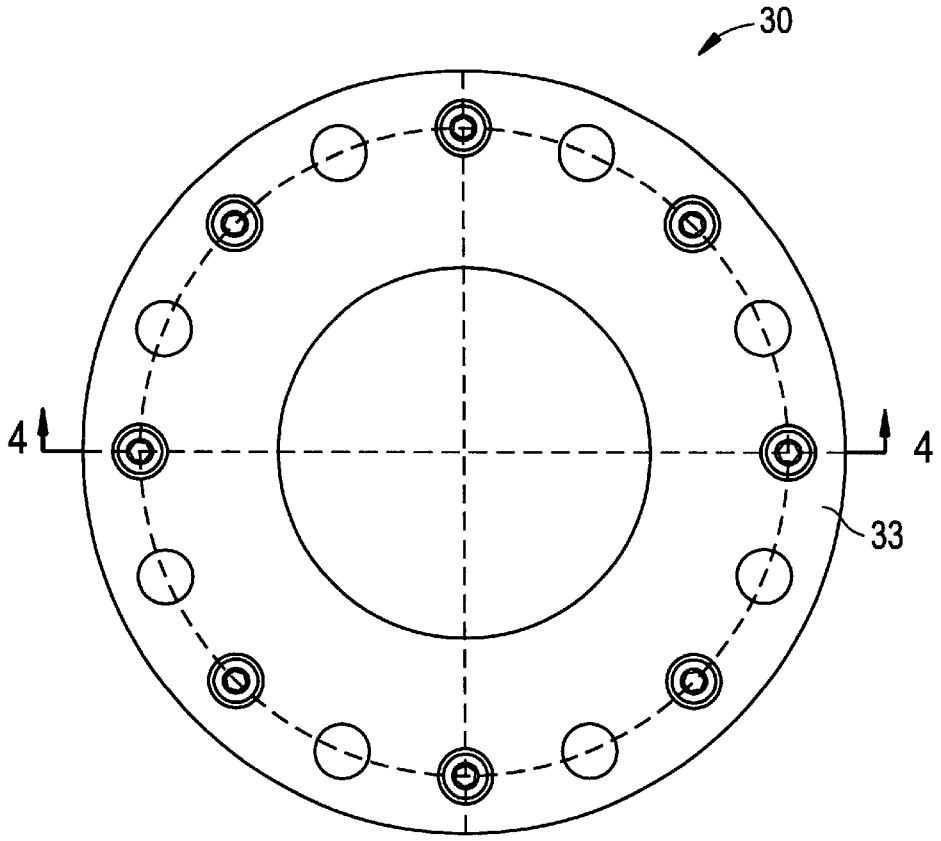
FIG. 3 shows a top view of a pressure transducer in accordance with another embodiment of the present invention.
Figure 4:
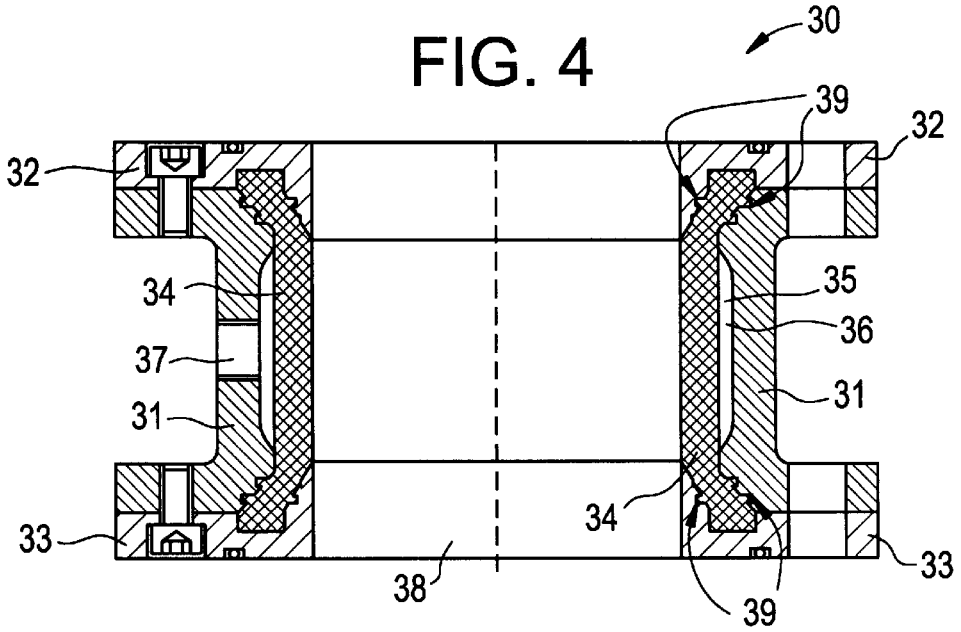
FIG. 4 shows a cross-sectional view of the pressure transducer of FIG. 3 as viewed from section 4—4.

FIG. 3 shows a top view of a pressure transducer 30 in accordance with an alternative embodiment of the present invention. As can be more clearly seen in the cross-sectional view illustrated in FIG. 4, the pressure transducer 30 includes a tubular element 31. At each of the two ends of the tubular element 31, two flanges 32 and 33 are provided for fixedly mounting the pressure transducer 30 to the core tube 12. An elastic element 34 made from an elastic material is provided on an interior of the tubular element 31 in a manner to form a circular groove 36 between the tubular element 31 and the elastic element 34 which can serve as a measuring chamber 35. The elastic element 34 is fixedly retained between the tubular element 31 and the two flanges 32 and 33 by a correspondingly constructed retaining surfaces, which in the present embodiment, are illustrated as roughened retaining surfaces 39. The internal diameter of the elastic element 34 and the two flanges 32 and 33 are properly designed with respect to one another such that a suspension passage 38 is formed in the pressure transducer 30. The pressure transducer 30 is mounted in communication with the suspension channel 26 of a core tube 12 to allow the flow of the solidifying suspension material through the pressure transducer 30.

The pressure of the solidifying suspension material within the suspension channel 26, and correspondingly, the pressure in the suspension passage 38, causes the elastic element 34 to deflect thereby resulting in a pressure change within the measuring chamber 35. This pressure change can then be detected by a sensor (not shown) which can be positioned a retaining hole 37 in pressure communication with the measuring chamber 35. The pressure signal from the sensor may then be used in the manner described previously to control the pressure of the solidifying suspension material. In addition, the support element 30 may also be provided with a transponder previously discussed to allow wireless transmission of power and/or data to/from the sensor.

Figure 5:
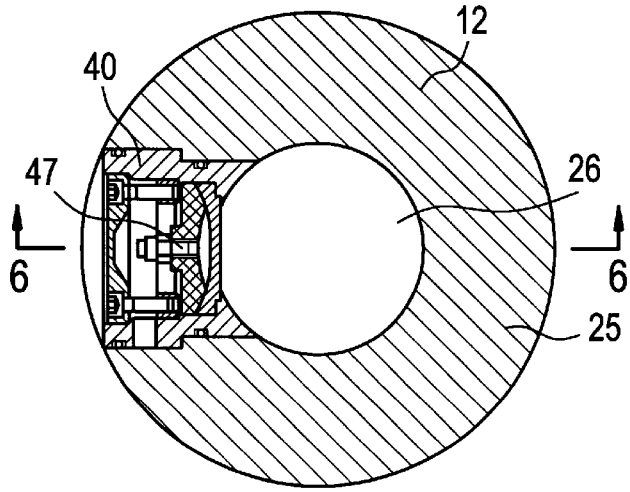
FIG. 5 shows a cross-sectional view of yet another embodiment of a pressure transducer in accordance with the present invention.
Figure 7:
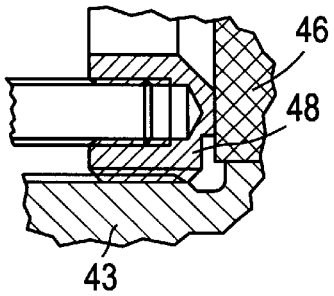
FIG. 7 shows a detail view of the locking ring used in the pressure transducer of FIG. 6.
Figure 6:
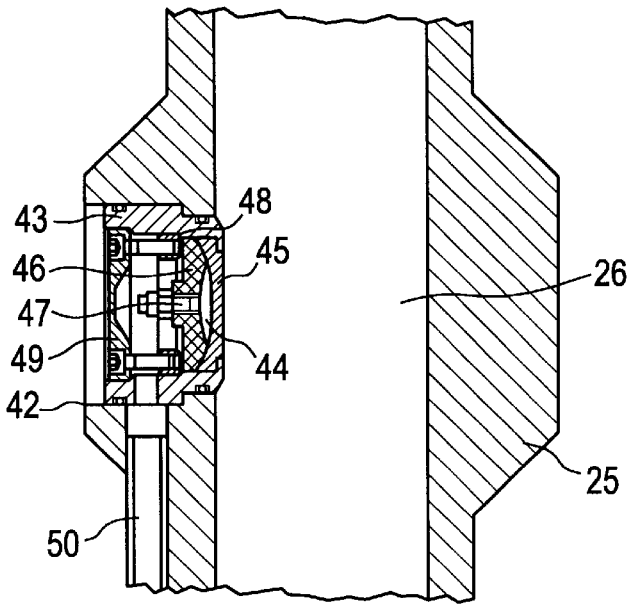
FIG. 6 shows a cross-sectional view of the pressure transducer of FIG. 5 as viewed from section 6—6.

FIGS. 5 to 7 show yet another alternative embodiment of pressure transducer 40 for an apparatus in accordance with the present invention. In this embodiment, the pressure transducer 40 is fitted within a reception hole 42 in the inner tube 25 of the core tube 12. As can be seen, the reception hole 42 is in fluid communication with the suspension channel 26 thereby allowing pressure measurements. In this regard, an elastically deformable measuring chamber wall 45 is provided at an open end of the sleeve-like support element 43 facing the suspension channel 26. Furthermore, the pressure transducer 40 may also include a facing sensor wall 46 which can be made from a dimensionally stable or elastic material. In the illustrated embodiment, both the measuring chamber wall 45 and the facing sensor wall have concave surfaces such that a lenticularly shaped measuring chamber 44 is formed thereinbetween. A sensor 47 is provided positioned at approximately the center of the sensor wall 46 for measuring the pressure within the lenticularly shaped measuring chamber 44. A peripheral edge portion of the sensor wall 46 is fixedly held together with a peripheral edge portion of the measuring chamber wall 45 by a locking ring 48 illustrated in FIG. 7, which in the present embodiment, has a screw connection with the support element 43. In addition, a cover plate 49 may also be provided for protecting the sensor 47.

A pressure change within the suspension channel 26 causes a deflection in the measuring chamber wall 45 thereby causing a corresponding pressure change in the measuring chamber 44. This pressure change can be detected by the sensor 47 and the pressure measurement can be provided to a control unit (not shown) by a lead (not shown) provided along a channel 50. The pressure measurement can then be utilized by the control unit in accordance with a predetermined program to set the pressure of the solidifying suspension material to a desired value by adapting the capacity of the pump or by regulating a pressure valve in the manner described previously. Of course, the pressure transducer 40 may also be provided with a transponder device previously discussed to allow wireless transmission of power/data to/from the sensor.

In the above described manner, the present invention allows a pressure-dependent control of the solidifying suspension material pressure in the hole. As a result of a pressure measurement in the area of the filing hole in accordance with the present invention, it is now possible to optimize the pumping pressure such that rapid filling of the hole with the solidifying suspension material can be attained while at the same time, excess pressure can be reduced thereby minimizing the amount of the solidifying suspension material wasted in filling of neighboring soil.

From the foregoing, it should now be apparent how the present invention provides an improved apparatus for erecting a foundation element in the ground by providing a pressure transducer that measures the pressure of the solidifying suspension material. It should also be evident how the present invention provides such an apparatus where the waste of solidifying suspension material is minimized by optimally controlling the pressure of the solidifying suspension material. In addition, it should further be evident how the present apparatus minimizes the time required to complete the filling process thereby maximizing process efficiency.

While various embodiments in accordance with the present invention have been shown and described, it is to be understood that the invention is not limited thereto, and may be changed, modified and further applied by those skilled in the art. In this regard, where as the present invention was illustrated and discussed as applied to a compact and robust drilling devices such as a continuous screw auger, the present invention is also suitable for variety of drilling devices in which a filling of the hole takes place during extraction of the drilling device. Therefore, this invention is not limited to the details shown and described previously but also includes all such changes and modifications which are encompassed by the appended claims.

I claim:

1. Apparatus for erecting a foundation element in a ground surface comprising:

a drilling device having a hollow core tube and an auger bit for drilling a hole in said ground surface, said hollow core tube defining a substantially central suspension passage sized to allow flow of a solidifying suspension material therethrough;

a pumping device for pumping said solidifying suspension material under pressure through said suspension passage of said hollow core tube into the hole in said ground surface;

a pressure transducer mounted on said hollow core tube for providing a pressure signal indicative of a pressure of said solidifying suspension material, said pressure transducer having a measuring chamber formed by an elastic wall which at least partially defines said suspension passage of said hollow core tube; and a control unit for controlling said pressure of said solidifying suspension material;

wherein increasing pressure in said suspension passage causes said elastic wall to be displaced radially outwardly from said suspension passage thereby increasing pressure in said measuring chamber.

2. Apparatus of claim 1, wherein said pressure transducer is positioned proximate to said auger bit.

3. Apparatus of claim 1, wherein said control unit controls said pumping device based on said pressure signal from said pressure transducer.

4. Apparatus of claim 3, wherein said pressure transducer is electrically connected to said control unit through a lead within said hollow core tube and is electrically connected to a slip ring and a sliding contact that electrically engages said slip ring.

5. Apparatus of claim 4, wherein said slip ring is positioned at an end of said drilling device remote from said auger bit.

6. Apparatus of claim 4, wherein said pressure transducer is electrically connected to said control unit to allow transmission of at least one of a pressure signal and an electrical power.

7. Apparatus of claim 1, wherein said drilling device comprises a screw auger and a feed helix helically attached on an outer surface of said hollow core tube.

8. Apparatus of claim 1, wherein said core tube is a multiple-walled core tube comprising at least two coaxial tubes.

9. Apparatus of claim 8, wherein said core tube is a double-walled core tube comprising an outer tube and an inner tube.

10. Apparatus of claim 1, wherein said pressure transducer includes a tubular element and said elastic wall is provided on said tubular element to form said measuring chamber thereinbetween, and a sensor for measuring pressure in said measuring chamber.

11. Apparatus of claim 10, wherein said pressure transducer includes two flanges for mounting of said pressure transducer to said hollow core tube.

12. Apparatus of claim 1, further comprising a reception hole adapted to receive said pressure transducer on said hollow core tube, and a sensor for measuring pressure in said measuring chamber.

13. Apparatus of claim 12, wherein said pressure transducer further includes a locking ring for fixedly holding together a peripheral edge portion of said sensor wall and a peripheral edge portion of said measuring chamber wall.

14. Apparatus of claim 1, further comprising a transponder device for providing wireless signal transmission from said pressure transducer to said control unit.

15. Apparatus of claim 1, further comprising a transponder device for providing wireless power transmission from a power supply to said pressure transducer.

16. Apparatus for erecting a foundation element in a ground surface comprising:

a drilling device having a hollow core tube and an auger bit for drilling a hole in said ground surface, said hollow core tube defining a substantially central suspension passage sized to allow flow of a solidifying suspension material therethrough, said auger bit defining an increased diameter chamber in a lower area of said core tube and said suspension passage being open to said increased diameter chamber area from which said solidifying suspension material flows into the hole in the ground surface upon extraction of said drilling device;

a pumping device for pumping said solidifying suspension material under pressure through said suspension passage of said hollow core tube into the hole in said ground surface;

a pressure transducer mounted on said hollow core tube for providing a pressure signal indicative of a pressure of said solidifying suspension material, said pressure transducer having a measuring chamber formed by an elastic wall which at least partially defines said increased diameter chamber; and a control unit for controlling said pressure of said solidifying suspension material;

wherein increasing pressure in said increased diameter chamber causes said elastic wall to be displaced axially upwardly from said increased diameter chamber thereby increasing pressure in said measuring chamber.

17. Apparatus of claim 16, further comprising a reception hole adapted to receive said pressure transducer on said hollow core tube, and a sensor for measuring pressure in said measuring chamber.

18. Apparatus of claim 16, wherein said pressure transducer is electrically connected to said control unit through a lead within said hollow core tube and is electrically connected to a slip ring and a sliding contact that electrically engages said slip ring.

19. Apparatus of claim 18, wherein said pressure transducer is electrically connected to said control unit to allow transmission of at least one of a pressure signal and an electrical power.

* * * * *